US007243461B2

(12) United States Patent
Rogers, Jr. et al.

(10) Patent No.: US 7,243,461 B2
(45) Date of Patent: Jul. 17, 2007

(54) HINGE MECHANISM FOR A SLIDING DOOR

(76) Inventors: Lloyd W. Rogers, Jr., 53601 Wolf Dr., Shelby Township, MI (US) 48316; Michael A. Ciavaglia, 825 Mohawk, Dearborn, MI (US) 48124

( * ) Notice: Subject to any disclaimer, the term of this patent is extended or adjusted under 35 U.S.C. 154(b) by 372 days.

(21) Appl. No.: 10/798,792

(22) Filed: Mar. 11, 2004

(65) Prior Publication Data

US 2004/0216383 A1 Nov. 4, 2004

Related U.S. Application Data

(60) Provisional application No. 60/455,989, filed on Mar. 19, 2003.

(51) Int. Cl.
*E05F 11/54* (2006.01)

(52) U.S. Cl. ..... 49/360; 296/155; 49/209

(58) Field of Classification Search ..... 49/360, 49/209, 210, 213, 216, 220, 221; 296/155
See application file for complete search history.

(56) References Cited

U.S. PATENT DOCUMENTS

| | | | |
|---|---|---|---|
| 3,653,154 | A | 4/1972 | Hayday |
| 4,121,382 | A | 10/1978 | Dietrich et al. |
| 4,163,432 | A | 8/1979 | Hertfelder |
| 4,184,577 | A | 1/1980 | Miller |
| 4,191,068 | A | 3/1980 | Jardin et al. |
| 4,223,927 | A | 9/1980 | Kobayashi et al. |
| 4,247,001 | A | 1/1981 | Wiegner |
| 4,281,475 | A | 8/1981 | Spadoni-Censi |
| 4,285,421 | A | 8/1981 | Halsted |

(Continued)

FOREIGN PATENT DOCUMENTS

EP 0421776 A2 4/1991

(Continued)

OTHER PUBLICATIONS

PCT/US04/08259—International Search Report Dated Mar. 9, 2005.

(Continued)

*Primary Examiner*—Gregory J. Strimbu
(74) *Attorney, Agent, or Firm*—Patrick M. Griffin

(57) ABSTRACT

A hinge assembly for coupling a sliding door of a vehicle to a drive unit for sliding the sliding door from an open position to a closed position, the drive unit causing the hinge assembly to slide within a guide track as the door moves between the open position and the closed position, the hinge assembly comprising: a first hinge portion; a second hinge portion, the first hinge portion being pivotally secured to the second hinge portion; a cable attachment being secured to the second hinge portion; and a guide surface disposed on a surface of the first hinge portion, the guide surface being configured to make contact with a portion of a cable having an end secured to the cable attachment when the second hinge portion is in a first orientation with respect to the position of the first hinge portion and the cable no longer makes contact with the guide surface as the second hinge portion moves from the first orientation to a second orientation with respect to the first hinge portion.

5 Claims, 6 Drawing Sheets

U.S. PATENT DOCUMENTS 4,462,185 A 7/1984 Shibuki et al.
4,530,185 A 7/1985 Moriya et al.
4,640,050 A 2/1987 Yamagishi et al.
4,644,693 A 2/1987 Wang
4,744,449 A 5/1988 Sekella et al.
4,880,199 A 11/1989 Harney
4,887,390 A * 12/1989 Boyko et al. ..... 49/214
4,916,861 A 4/1990 Schap
4,932,715 A 6/1990 Kramer
4,945,677 A 8/1990 Kramer
4,952,080 A 8/1990 Boiucaner et al.
4,966,045 A 10/1990 Harney
5,004,280 A 4/1991 Schap
5,014,958 A 5/1991 Harney
5,039,925 A 8/1991 Schap
5,046,283 A 9/1991 Compeau et al.
5,056,633 A 10/1991 Noel
5,066,056 A 11/1991 Schap
5,076,016 A 12/1991 Adams et al.
5,105,131 A 4/1992 Schap
5,127,190 A 7/1992 Hein et al.
5,138,795 A 8/1992 Compeau et al.
5,168,666 A 12/1992 Koura et al.
5,178,026 A 1/1993 Matsumoto
5,189,839 A 3/1993 DeLand et al.
5,263,762 A 11/1993 Long et al.
5,295,038 A 3/1994 Matsushita et al.
5,316,365 A 5/1994 Kuhlman et al.
5,319,880 A 6/1994 Kuhlman
5,319,881 A 6/1994 Kuhlman
5,323,570 A 6/1994 Kuhlman et al.
5,326,473 A 7/1994 Lacombes
5,336,165 A 8/1994 Twardowski
5,347,755 A 9/1994 Jaster et al.
5,350,986 A 9/1994 Long et al.
5,351,439 A 10/1994 Takeda et al.
5,396,158 A 3/1995 Long et al.
D358,291 S 5/1995 Lee
5,434,487 A 7/1995 Long et al.
5,477,093 A 12/1995 Lamb
5,477,094 A 12/1995 Lamb
5,487,827 A 1/1996 Peterson et al.
5,507,119 A 4/1996 Sumiya et al.
5,547,645 A 8/1996 Ego et al.
D374,481 S 10/1996 McCallister et al.
D376,424 S 12/1996 Macauley et al.
5,582,279 A 12/1996 Buchanan, Jr. et al.
5,591,344 A 1/1997 Kenley et al.
5,658,456 A 8/1997 Kenley et al.
5,668,424 A 9/1997 Lamb
5,691,587 A 11/1997 Lamb
5,692,410 A 12/1997 Fenelon
5,737,876 A 4/1998 Dowling
5,746,025 A * 5/1998 Shimura ..... 49/360
5,755,059 A 5/1998 Schap
D395,517 S 6/1998 Treu et al.
5,778,843 A 7/1998 Inoue et al.
5,788,099 A 8/1998 Treu et al.
5,813,282 A 9/1998 Azuma
D403,079 S 12/1998 Pawlak
5,867,940 A 2/1999 Watanaba et al.
5,875,588 A 3/1999 Torii et al.
5,892,340 A 4/1999 Sasajima et al.
5,906,071 A 5/1999 Buchanan, Jr.
5,909,073 A 6/1999 Lamb
5,913,563 A 6/1999 Watanabe et al.
5,943,913 A 8/1999 Fenelon
5,956,998 A 9/1999 Fenelon
5,979,114 A 11/1999 Clark et al.
5,982,126 A 11/1999 Hellinga et al.
5,982,131 A 11/1999 Aino
6,003,193 A 12/1999 Rivin et al.
6,009,671 A 1/2000 Sasaki et al.
6,027,032 A 2/2000 Aoki et al.
6,032,415 A 3/2000 Tajima
6,038,818 A 3/2000 Haag et al.
6,100,619 A 8/2000 Buscher et al.
6,108,976 A 8/2000 Kato et al.
6,114,820 A 9/2000 Nishigaya
6,125,586 A 10/2000 Buscher
6,134,836 A 10/2000 Kawanobe et al.
6,134,837 A 10/2000 Kawanobe et al.
6,161,894 A 12/2000 Chapman
6,179,742 B1 1/2001 Haag et al.
6,183,040 B1 2/2001 Imaizumi et al.
6,198,242 B1 3/2001 Yokomori et al.
6,199,322 B1 3/2001 Itami et al.
6,216,393 B1 4/2001 Apprich
6,231,113 B1 5/2001 Armbruster et al.
6,237,737 B1 5/2001 Jorgensen et al.
6,247,373 B1 6/2001 Bree et al.
6,270,148 B1 8/2001 Noda et al.
6,270,149 B1 8/2001 Fukumoto et al.
6,390,535 B1 5/2002 Chapman
6,397,523 B1 6/2002 Fukumoto et al.
6,405,485 B1 6/2002 Itami et al.
6,408,573 B1 6/2002 Fukumoto et al.
6,425,206 B1 7/2002 Noda et al.
6,430,875 B1 8/2002 Clark et al.
6,460,295 B1 10/2002 Johnson et al.
6,464,287 B2 10/2002 Rogers, Jr. et al.
6,481,783 B1 11/2002 Rogers, Jr. et al.
6,530,619 B2 * 3/2003 Fukumoto et al. ..... 296/155
6,553,719 B1 * 4/2003 Stone et al. ..... 49/358
6,561,569 B1 5/2003 Risdon et al.
6,575,864 B1 6/2003 Dean
6,588,829 B2 7/2003 Long et al.
2001/0022049 A1 9/2001 Clark et al.
2003/0005640 A1 * 1/2003 Moreau ..... 49/360
2003/0046872 A1 3/2003 Fukumura et al.
2005/0039404 A1 * 2/2005 Mrkovic et al. ..... 49/360

FOREIGN PATENT DOCUMENTS

EP 0626498 B1 1/1997
EP 0625625 B1 3/1997
EP 0625815 B1 3/1997
EP 0609585 B1 4/1997
EP 0611869 B1 5/1997
EP 0980776 A2 2/2000
GB 2097855 A 11/1982
GB 2323124 A 9/1998
JP 07067293 A 3/1995
JP 2000-160933 6/2000
WO WO02/072374 A1 9/2002

OTHER PUBLICATIONS

PCT/US04/08259—The Written Opinion Dated Mar. 9, 2005.

* cited by examiner

HINGE MECHANISM FOR A SLIDING DOOR

CROSS REFERENCE TO RELATED APPLICATIONS

This application claims the benefit of U.S. provisional application Ser. No. 60/455,989 filed Mar. 19, 2003, the contents of which are incorporated herein by reference thereto.

This application is also related to U.S. patent application ser. No. 10/798,733, filed contemporaneously with the present application, the contents of which are incorporated herein by reference thereto.

TECHNICAL FIELD

The present application relates to vehicle doors and more particularly the present application relates to an apparatus and method for opening and closing a power sliding door.

BACKGROUND

A typical vehicle is manufactured with a plurality of openable doors. Each door is typically mounted on hinges within a door opening. Some larger vehicles have sliding doors that slide from an open position to closed position thus, egress and ingress of the vehicle is possible without requiring a large open area beside the vehicle to allow for pivoting of the door. This is particularly useful in parking lots where the area between the vehicles is typically not large enough to allow for full pivoting of the opening doors. Moreover, such sliding doors also allow the vehicles to have larger door openings.

Accordingly, sliding doors provide access to large door openings without requiring a large area adjacent to the vehicle which would be required for a door that pivots on its hinge. In one configuration, a power sliding door is supported and guided by an upper track, a center track and a lower track. An upper roller is attached to the power sliding door and travels in the upper track. A lower roller is attached to a lower portion of the sliding door and runs or travels in the lower track. A hinge and roller assembly is pivotally attached to a rear portion (e.g., towards the rear of the vehicle) of the door between the upper and lower portions of the door. The hinge and roller assembly is also received in the track to allow for sliding or movement of the door.

In addition to the usage of sliding doors in vehicles, power drive systems have been implemented wherein automatic opening, closing, locking and unlocking of the sliding door is facilitated through a drive system coupled to the sliding door. Presently, some sliding doors are driven through cables attached to the forward and aft sides of the center roller hinge (e.g., a hinge mounted towards the center of the door with respect to the upper and lower edges of the same). During installation on the vehicle, the cables are separately routed into the interior of the vehicle housing (e.g., between the inner and outer surfaces of the vehicle body) through holes in the sheet metal and are wrapped around pulleys of the power sliding door drive unit within the vehicle. These systems are complex, non-modular, cumbersome to install, and require the cables to be routed through the vehicle, the system, tensioned and then secured to the hinge during assembly of the system on the vehicle (e.g., on the assembly line).

The drive unit output force necessary to seal the door with the front cable attached to the center roller hinge is larger than the door seal force (e.g., the necessary seal force applied normal to the surface of the door or inwardly towards the vehicle from the exterior of the door). The aforementioned seal force refers to the force necessary to close the door when it is positioned over or about the door opening into which the door is received. The previously mentioned difference in required seal force is typically due to the inefficiency of transferring the force from the cable to the door via the center roller hinge/roller track/door interface.

In addition, non-modular power drive systems include many components that must be installed together on the assembly line. Accordingly, many power sliding doors and their associated non-modular drive systems require significant work to install on the assembly line as multiple separate components must be installed and tested during the vehicle assembly process. Moreover, the configuration of these systems effect the efficiency of the motor drive unit thereby requiring additional power to close the vehicle door as it slides in the guide tracks.

Accordingly, it is desirable to provide a power drive system for a vehicle sliding door that is efficient in transferring force to the sliding door and is easy to install. Moreover, it is desirable to provide a system that does not take up a large amount of space within the vehicle.

SUMMARY OF THE INVENTION

An apparatus and method for providing a sliding door mechanism having an efficient transference of closing forces to the sliding door, in one exemplary embodiment the apparatus comprises a hinge assembly for coupling a sliding door of a vehicle to a drive unit for sliding the sliding door from an open position to a closed position, the drive unit causing the hinge assembly to slide within a guide track as the door moves between the open position and the closed position, the hinge assembly comprising: a first hinge portion; a second hinge portion, the first hinge portion being pivotally secured to the second hinge portion; a cable attachment being secured to the second hinge portion; and a guide surface disposed on a surface of the first hinge portion, the guide surface being configured to make contact with a portion of a cable having an end secured to the cable attachment when the second hinge portion is in a first orientation with respect to the first hinge portion position and the cable no longer makes contact with the guide surface as the second hinge portion moves from the first orientation to a second orientation with respect to the first hinge portion.

In another exemplary embodiment, a drive assembly for a sliding door, comprises: a guide track having a curved portion disposed at one end; a hinge assembly comprising: a first hinge portion, a second hinge portion, the first hinge portion being pivotally secured to the second hinge portion; a cable attachment being secured to the second hinge portion; and a guide surface disposed on a surface of the first hinge portion, the guide surface being configured to make contact with a portion of a first cable having an end secured to the cable attachment when the second hinge portion is in a first orientation with respect to the first hinge portion position and the portion of the first cable no longer makes contact with the guide surface as the second hinge portion moves from the first orientation to a second orientation with respect to the first hinge portion; a second cable secured to the first hinge portion at one end; a drive unit for providing a tension to the first cable to cause the first hinge portion to travel within the guide track in a first direction and for providing a tension to the second cable to cause the first hinge portion to travel within the guide track in a second direction; wherein the second hinge portion moves from the first orientation to a second orientation as the first hinge portion travels in the curved portion of the guide track.

In yet another exemplary embodiment, a method is provided for closing a sliding door of a vehicle, the method comprising: aligning the door with a door opening of the vehicle; directly providing a pulling force to a rear portion of the door by a cable that is aligned with a surface of a pulley and the rear portion of the door, wherein the pulling force causes the door to travel inward into the door opening.

In yet another exemplary embodiment, a method for providing a closing force to a sliding door of a vehicle, comprises: securing one end of a cable to the sliding door; securing another end of the cable to the motor drive unit for providing a pulling force to the cable; pivotally securing a first hinge portion to a second hinge portion, the second hinge portion being secured to the sliding door and the first hinge portion being slidably received within a guide track having a curved portion; wherein the cable makes contact with a guide member of the first hinge portion when the first hinge portion is not traveling within the curved portion and wherein a direct force is applied to a portion of the sliding door when the first hinge portion is traveling in the curved portion and the cable no longer makes contact with the guide member.

DETAILED DESCRIPTION OF EXEMPLARY EMBODIMENTS

Exemplary embodiments of the present invention relate to an apparatus and method for providing an efficient transfer of a door closing and opening force to a sliding door. In particular an assembly and method is provided wherein efficient transference of a door seal force is achieved.

Prior apparatus and methods for providing and/or effectuating moving of a sliding door of a vehicle are found in U.S. Pat. Nos. 5,046,283; 5,313,795; 5,319,880; 5,319,881; 5,323,570; 6,390,535; 6,464,287; 6,481,783; and 6,561,569 the contents of which are incorporated herein by reference thereto.

An exemplary embodiment of the present invention provides a means for providing an efficient seal force transfer. In addition, the overall size of the unit is reduced thereby decreasing the associated manufacturing costs. In one embodiment, the system will be modular so that all the components needed for the power sliding door drive unit will be attached to either the center or lower track of the vehicle. This allows for an easy slide in assembly sequence for the vehicle assembly line. The system will also keep valuable space in the door and rear quarter available for other items in a vehicle.

Figure 1:
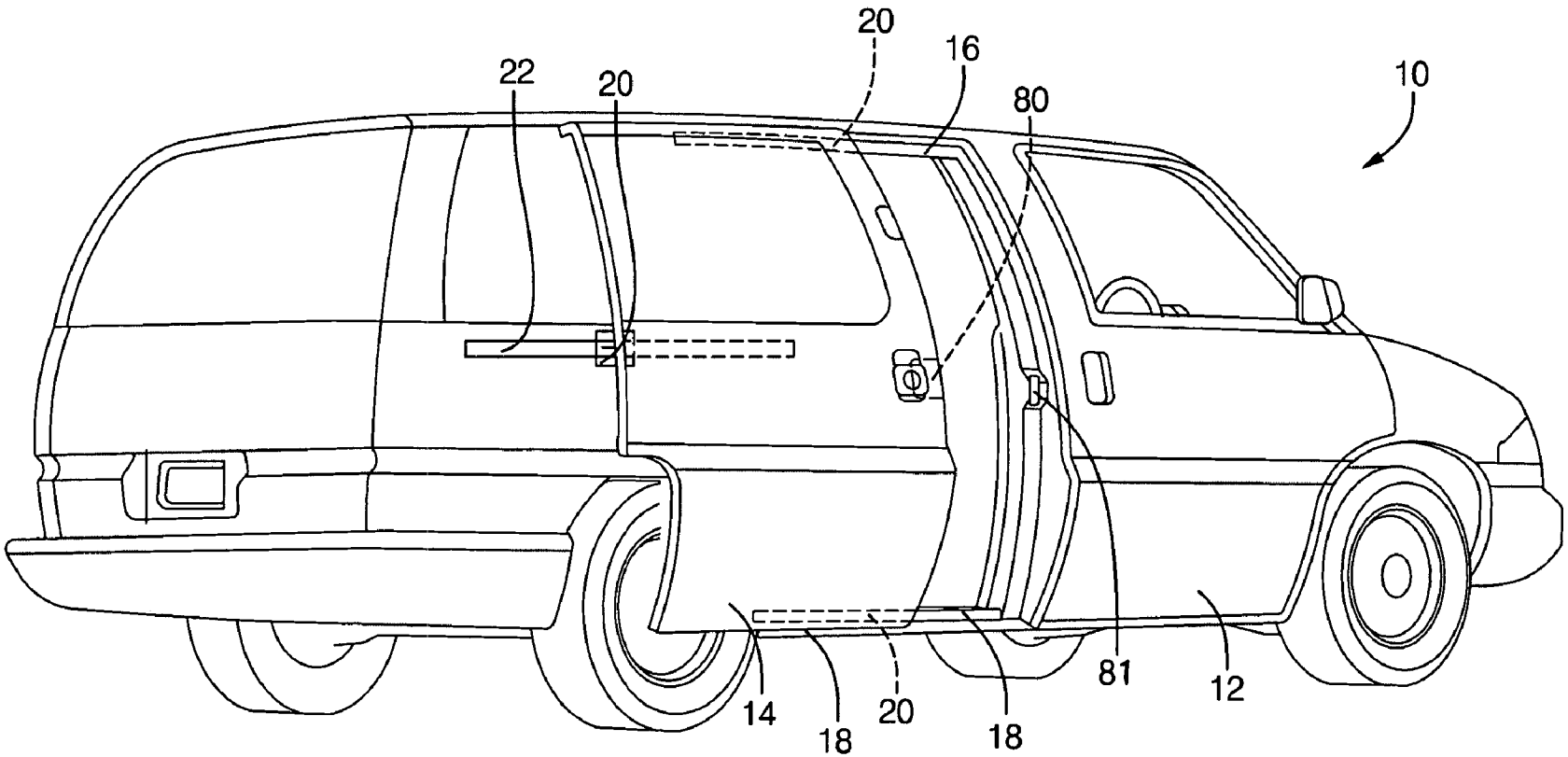
FIG. 1 is a right hand perspective side view of a vehicle having a sliding door installed therein.

Referring now to FIG. 1, a vehicle 10 with a front pivoting door 12 and a power sliding door 14 is illustrated. Here power sliding door 14 is guided by rollers that are slidably received in an upper track 16 and a lower track 18. The rollers 20 are configured to be received in upper track 16 and lower track 18. In addition, to upper track 16 and lower track 18 and in accordance with an exemplary embodiment a center track 22 is also provided. Center track 22 is also configured to receive and engage a roller 20 that is coupled to sliding door 14. The location of rollers 20 depends on the track used (center or lower) for providing the opening and closing force to the door.

Figure 2:
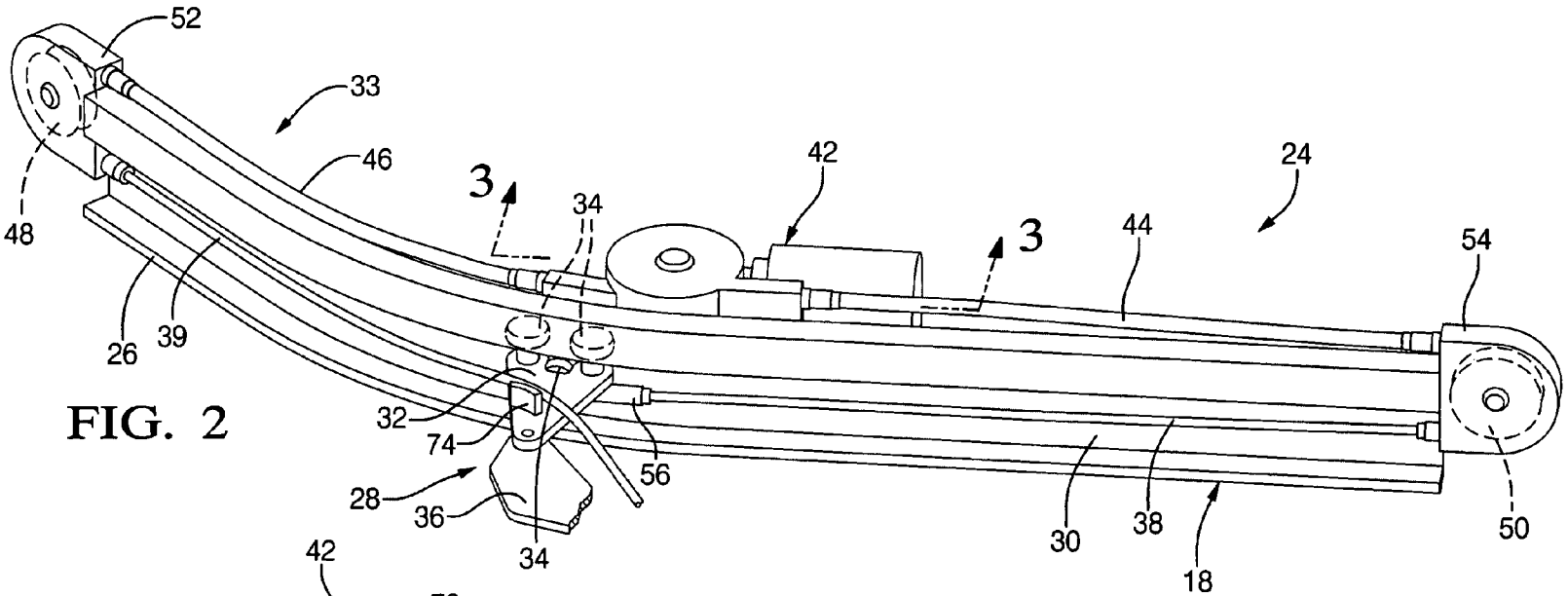
FIG. 2 is a perspective view of a modular power sliding door drive assembly constructed in accordance with an exemplary embodiment of the present invention.
Figure 3:
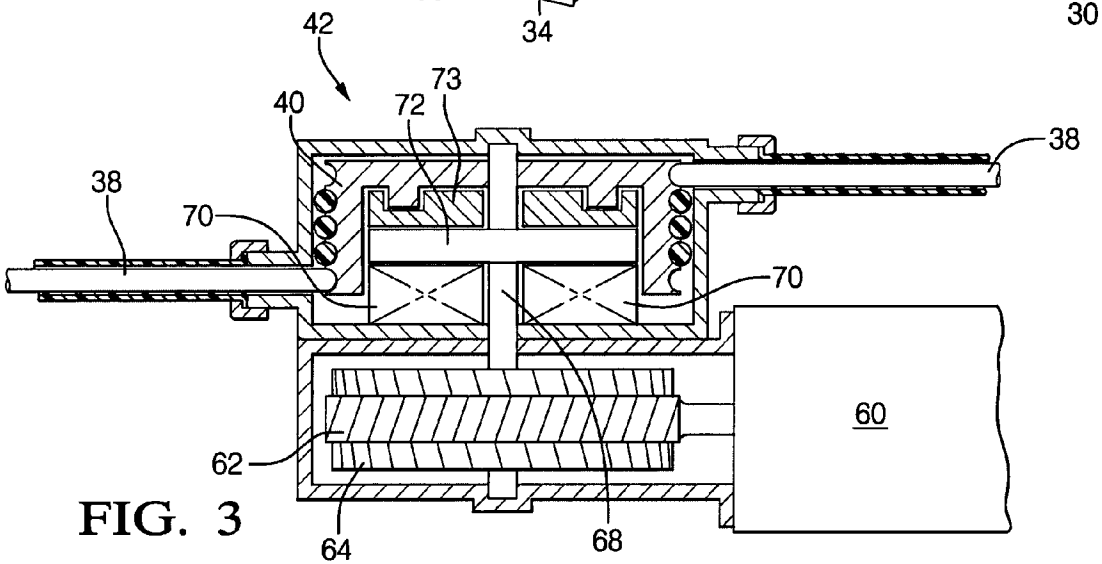
FIG. 3 is a view along lines 3-3 of FIG. 2.

Referring now to FIGS. 2 and 3, a door closing apparatus of a power sliding door system of an exemplary embodiment is illustrated. As illustrated, an exemplary embodiment comprises a system 24 wherein all the drive components are attached to either a lower sliding door track or a center sliding door track and the system is easily installed as a single unit. Alternatively, and as particular applications may require, the system comprises multiple parts (e.g., guide track, motor drive unit, hinge assembly, pulleys and cables that are each installed in separate steps or combinations thereof). In accordance with an exemplary embodiment system 24 comprises a door track 26 for defining a path of travel for the sliding door. The path of travel defines an open position of the door and a closed position of the door. In accordance with an exemplary embodiment system 24 is a cable drive system wherein cables are manipulated to drive a hinge assembly 28 that is secured to the sliding door.

Door track 26 defines a channel 30 for slidably receiving a first hinge portion 32 of hinge assembly 28. Door track 26 can be manufactured out of a steel stamping of any equivalent thereof wherein the curvature of the track is easily defined as well as the configuration of the channel. The door track is configured to be installed as a complete unit into the vehicle or may comprise multiple pieces. The door track will have a curved portion 33 that corresponds to the curvature of the vehicle about the vehicle door opening, in order to facilitate sliding of the door into and out of the door opening. For example, if the guide track and motor drive unit is used to provide a closing force via a center guide track, the motor drive unit will pull directly on the rear portion of the door via a cable secured directly to a rear portion of the door in order to close the door and curved portion 33 will wrap around the "C" pillar of the vehicle (e.g., the periphery of the vehicle door opening). Alternatively, and when the lower guide track is used to provide the motor drive unit the closing force is provided via a cable secured to a front portion of the sliding door as the guide track is partially disposed below the vehicle door opening and a portion of the curved portion will be located prior to and partially behind the "B" pillar. As referred to directly above "rear portion" and "front portion" of the door is understood to correspond to a forward portion or rear portion of the vehicle.

It is also understood that the length and degree or arc of the curvature of curved portion 33 will vary depending on vehicle types, or design and the location of the guide track (e.g., center or lower guide track, for example, some vehicle body types require a shorter length and a greater degree of arc or curvature for a center guide track as opposed to a lower guide track (longer length, smaller degree of arc or curvature).

One method or means for allowing first hinge portion 32 to be slidably received within channel 30 is to provide rollers 34, which will allow hinge portion 32 to slide therein. Alternatively, and in order to provide the sliding movement of first hinge portion 32 within guide track 26, a sliding guide block or other equivalent item is provided to achieve the sliding movement of portion 32 within guide track 26. Thus, alternative means other than rollers 34 are contemplated to be within the scope of the present invention. Also, portion 32 is pivotally secured to a second hinge portion or mounting portion 36 of hinge assembly 28. The pivotal securement of portions 32 and 36 will allow for the proper movement of the sliding door as it moves along the contour of track 26, which is configured to match the contour of the vehicle.

It is, of course, understood that the hinge assembly 28 may comprise a single unit with the pivotal movement being facilitated by the securement of one end to the door and the other end to the track. In this embodiment, the second hinge portion would be a portion of the sliding door or integrally formed with the sliding door. Hinge assembly 28 further comprises a cable attachment portion 35 (FIG. 4) that is secured to the sliding door and also provides a means for securing second hinge portion 36 to the door as well as a point of securement for a front cable of the system.

In an exemplary embodiment, the system comprises a pair of cables 38 and 39 which are secured to hinge assembly 28. One cable is a rear cable 38 secured to the first hinge portion and the other is a forward cable 39 secured to the cable attachment 35 or alternatively the second hinge portion. The other ends of the cables are each secured to a single drum 40 of a motor drive unit 42. The cables are attached to either side of the drum such that while one cable raps off the drum the other will rap on. The cables also passes through conduits 44 and 46. Conduits 44 and 46 extend out from the housing of motor drive unit 42 in opposite directions. Conduits 44 and 46 provide a means for protecting the cables from being damaged or interfered with as they wrap onto and off of cable drum 40. Alternatively, the system may be constructed without the cable conduits.

Disposed at either end of the track is a pair of cable pulleys 48 and 50. Pulleys 48 and 50 are rotatably mounted to the ends of track 26. Pulleys 48 and 50 allow the cable to transition from the conduit into the channels of track 26 and ultimately to cable tensioners or alternatively the cables are directly secured to a portion of hinge assembly 28. The cables extend out to the hinge assembly and/or door where they are attached to the same through spring tensioners 56 and 58. An intended purpose of tensioners 56 and 58 is to allow for the carrying length of cable needed throughout the sliding door's travel, especially through the bend in the track (e.g., the bend portion of the track necessary to transition the sliding door into its fully closed position). Again, it is contemplated that the system can be constructed without cable tensioners. The purpose of the tensioners is to allow for a varying length of cable needed throughout the sliding door's travel, especially through the bend in the track where increased forces may be required to pull the door into a locked position. Pulleys 48 and 50 are disposed within pulley housings 52 and 54, respectively. Housings 52 and 54 enclose and protect the pulleys and the cable from debris and contaminates that may affect performance of the same (e.g., increase resistance or cause undesirable noise or vibrations).

Accordingly, the cable pulleys provide a means for guiding and completing the cable loop which causes the desired movement of the hinge assembly. As discussed above the movement of the hinge is facilitated by winding one of the cables onto the cable drum while allowing the other cable to unwind therefrom thus, allowing the hinge to slide within the track.

Motor drive unit 42 provides the necessary driving force for the modular system 24. More particularly, motor drive unit 42 provides the force for rotating cable drum 40 in order to effect the desired movement of hinge 28 and ultimately sliding door 14.

It is noted that the unit illustrated in FIG. 2 is configured for use with a left hand or driver's side vehicle door opening and it is, of course, understood that the configuration of unit 24 may be modified for use in a left hand side opening illustrated in FIG. 1. Moreover, the unit is also contemplated for use as a center or lower guide track. However, and in accordance with an exemplary embodiment, the hinge assembly is contemplated for use with a center guide track wherein the closing force is applied to a rear portion of the vehicle door via a cable directly attached thereto such that the closing force can be directly applied to a rear portion of the door in an efficient manner such that engagement of a locking mechanism in close proximity to the rear portion of the door is easily achieved.

As illustrated in FIG. 3, a portion of component parts of a contemplated motor drive unit is illustrated. It is, of course, understood that the configuration illustrated in FIG. 3 is one example of a contemplated drive unit and the present invention is not intended to be limited by the same as other configurations may be possible as long as the required external dimensions are achieved while also providing the necessary driving force. As will be discussed herein, the configuration of hinge assembly 28 will allow the overall size of motor drive unit 42 to be reduced as hinge assembly 28 reduces the door seal force required.

As illustrated in FIG. 3 motor drive unit comprises a motor 60 for driving a shaft having a worm gear 62. Worm gear 62 is configured to threadingly engage a gear 64. Gear 64 is secured to one end of a shaft 68 rotatably received within an internal cavity defined by the housing of the motor drive unit.

The motor drive unit further comprises an electromagnetic clutch comprising a stationary coil 70 for generating an electromagnetic field in order to couple or uncouple a first friction plate or rotor 72 to another friction plate or armature or other equivalent item 73 wherein rotation of shaft 68 by motor 60 will determine whether output gear 40 will be driven by motor 60. In this embodiment friction plate 73 is configured to rotate with cable drum 40 or in other words rotation of friction plate 73 causes rotation of cable drum 40. Accordingly, motor 60 will drive or rotate first friction plate or rotor 72 and the cable drum will not be rotated until the coil is energized and the two friction plates engage each other thereby causing rotation of cable drum 40 and ultimately movement of hinge 28. The attraction of the two friction plates is caused by the electromagnetic field or magnetic flux generated by coil 70 as is known in the related arts.

Thus, when the electromagnetic clutch is engaged the door can be powered open or closed. When the clutch is released or the electromagnetic clutch is not engaged the door can be moved freely because the cable drum is allowed to move freely as there will be no frictional engagement between the two surfaces of armature 73 and rotor 72. It is of course understood that other clutch devices may be employed with the present invention as long as the require performance criteria are met.

In order to operate the power sliding door of vehicle 10 it is contemplated that a sensing system will be installed in vehicle 10 such that signals received will cause motor drive unit 42 to open or close the door. The sensing system will provide the necessary signals to a control module or microprocessor having an algorithm for executing commands pursuant to signals received from the sensors. An example of a sensor and controller arrangement can be found in U.S. Pat. Nos. 5,263,762; 5,350,986; 5,396,158; 5,434,487; and 6,247,373 the contents of which are incorporated herein by reference thereto. It is of course understood that the aforementioned U.S. patents merely provide examples of sensor and controller arrangements capable of being used with the present invention.

In accordance with an alternative exemplary embodiment guide track 26 is configured to define a cavity for receipt of the housing of the motor drive unit thus, and in this embodiment the modular drive unit will have an exterior profile or external dimensions that are no larger than those required for a guide track without a motor unit disposed therein or thereon.

In one embodiment wherein all of the aforementioned components are attached to the guide track it is easy for an operator on the vehicle assembly line to take the entire unit and slide it into the appropriate track areas and attach it with fasteners, which pass through predetermined mounting openings located on the guide track. Accordingly, the modular drive unit allows the same to be installed in the vehicle with significantly less steps than many other current power sliding doors as no other mechanical components are required. Thus, assembly 24 is located in its proper position and is secured by passing bolts or other securement means through pre-arranged drill holes.

In addition, and since the modular unit is self contained operation of the drive unit and movement of the hinge within track 26 can be manufactured tested and assembled at a location remote to where the unit is installed in the vehicle. Therefore, efficient practices for manufacturing modular system 24 are capable of being performed (e.g., drive unit testing) prior to the shipment and installation of the same in the vehicle.

Figure 4:
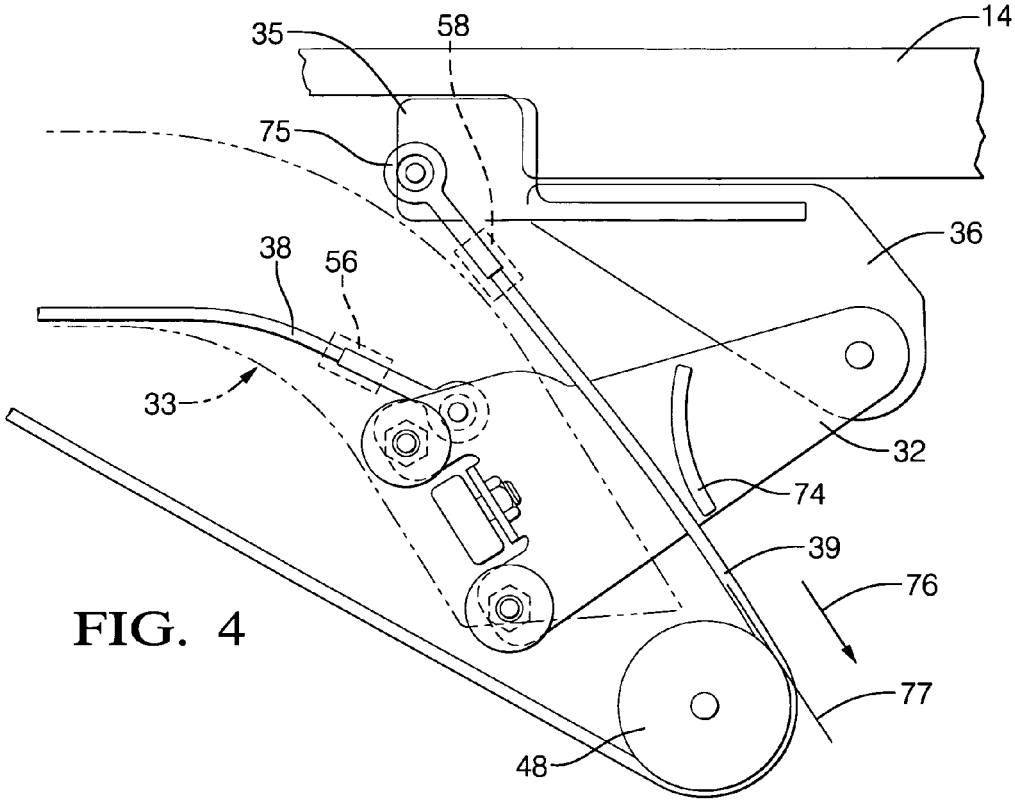
FIG. 4 is a top plan view of an exemplary embodiment of the present invention corresponding to a closed door position.
Figure 5:
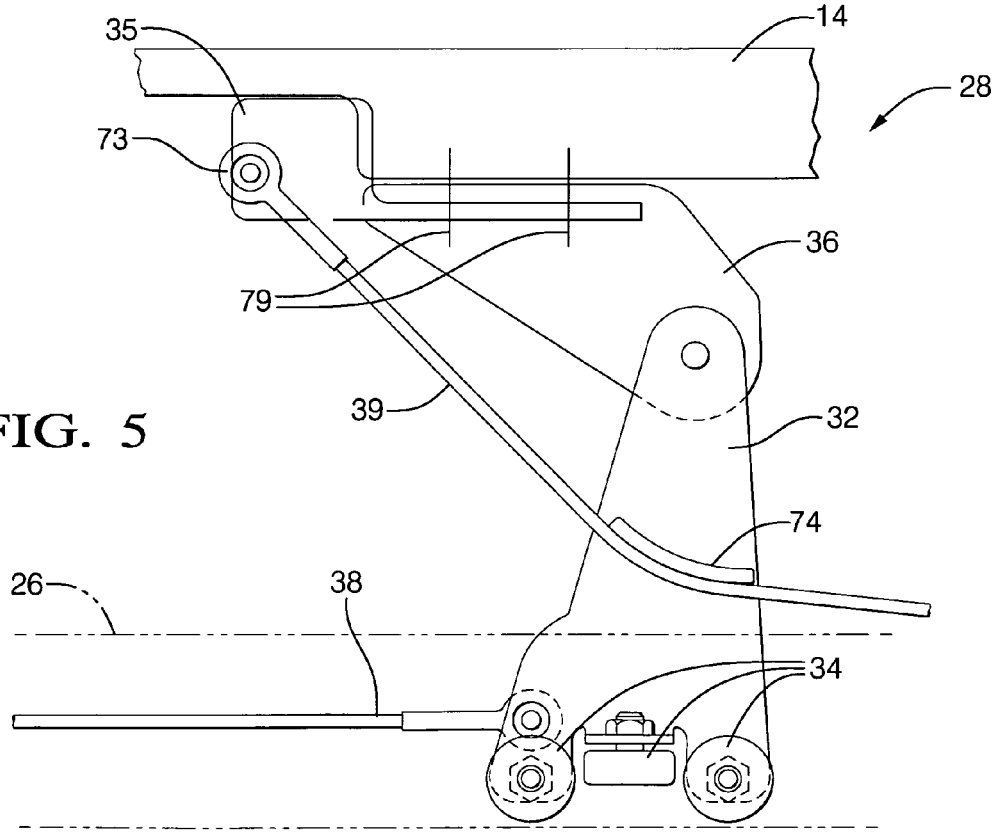
FIG. 5 is a top plan view of an exemplary embodiment of the present invention corresponding to an open door position.

Referring now to FIGS. 4 and 5, an exemplary embodiment of the present invention is illustrated. Here a more detailed view of hinge assembly 28 is provided. FIG. 4 illustrates the door and door closing mechanism in the closed position while FIG. 5 illustrates the door and the door closing mechanism in the open door position. The guide track illustrated in FIGS. 4 and 5 is a center guide track which is disposed between the upper and lower guide tracks and has a curved portion that wraps around the "C" pillar of the vehicle.

An exemplary embodiment attaches the front cable directly to the door by means of guiding the cable around a surface defined by a guide member 74 of hinge assembly 28. In one exemplary embodiment guide member 74 is mounted or integrally formed to protrude from a surface of first hinge portion 32. For example, in one non-limiting exemplary embodiment pinch portion 32 and guide member 74 may be formed from a stamped steel member or alternatively a casting process. Of course, other manufacturing processes are considered to be within the scope of the present invention. As illustrated, guide member 74 provides a curved surface such that a portion of cable 39 makes contact with a surface of guide member 74 as the door is in an open position (FIG. 5). In addition, the configuration and placement of guide member 74 keeps cable 39 taught in order to provide tension upon both cables 38 and 39 as hinge assembly 28 travels in the non-curved portion or slightly curved portion of guide track 26. Accordingly, no slacking of the cable is felt as the system travels through an open position to a closed position.

As the door moves into a closed position, second hinge portion 36 pivots with respect to first hinge portion 32 such that cable 39 no longer makes contact with guide member 74.

In this position it is now possible to directly provide a pulling force (via cable 39) on the sliding door in a direction generally indicated by arrow 76. As illustrated in FIGS. 4 and 5 (e.g., center guide track) the direct pulling of the cable is facilitated at a rear portion of the door. However, and if a lower guide track is used the direct pulling of the cable would be facilitated at a more forward or forward portion of the door. In an exemplary embodiment, the pulling force in the direction of arrow 76 is substantially a straight line (e.g., from point of securement to door to pulley 48). In accordance with an exemplary embodiment guide member 74 has a radius of curvature of sufficient to maintain the torque moment upon cable 39 (e.g., FIG. 5) as well as allowing the cable to no longer make contact as the door is closing (e.g., FIG. 4). Of course, it is understood that exemplary embodiments of the present invention are intended for use with guide member 74 having dimensions greater and or less than those illustrated in the attached Figures. In accordance with an exemplary embodiment of the present invention a generous surface is provided to receive the bending moment of the cable.

As illustrated in FIG. 4, the position of the door and accordingly the first hinge portion with respect to the second hinge portion as well as the location of pulley 48 will cause a cable point of securement 75 to the door to be aligned with a tangential plane 77 of pulley 48 thus, direct force in the direction of arrow 76 is achieved.

Cable connector 35 provides a means for securing an end of cable 39 to sliding door 14. In addition, and in an alternative exemplary embodiment cable connector 35 also provides a means for securing second hinge portion 36 to door 14 by passing a plurality of securing members 79 through and secured to a plurality of openings and cable connector 35, second hinge portion 36 and door 14. For example, securing members 79 may comprise bolts, screws, etc. for providing a means for securing items to door 14 as well as each other.

Figure 8A:
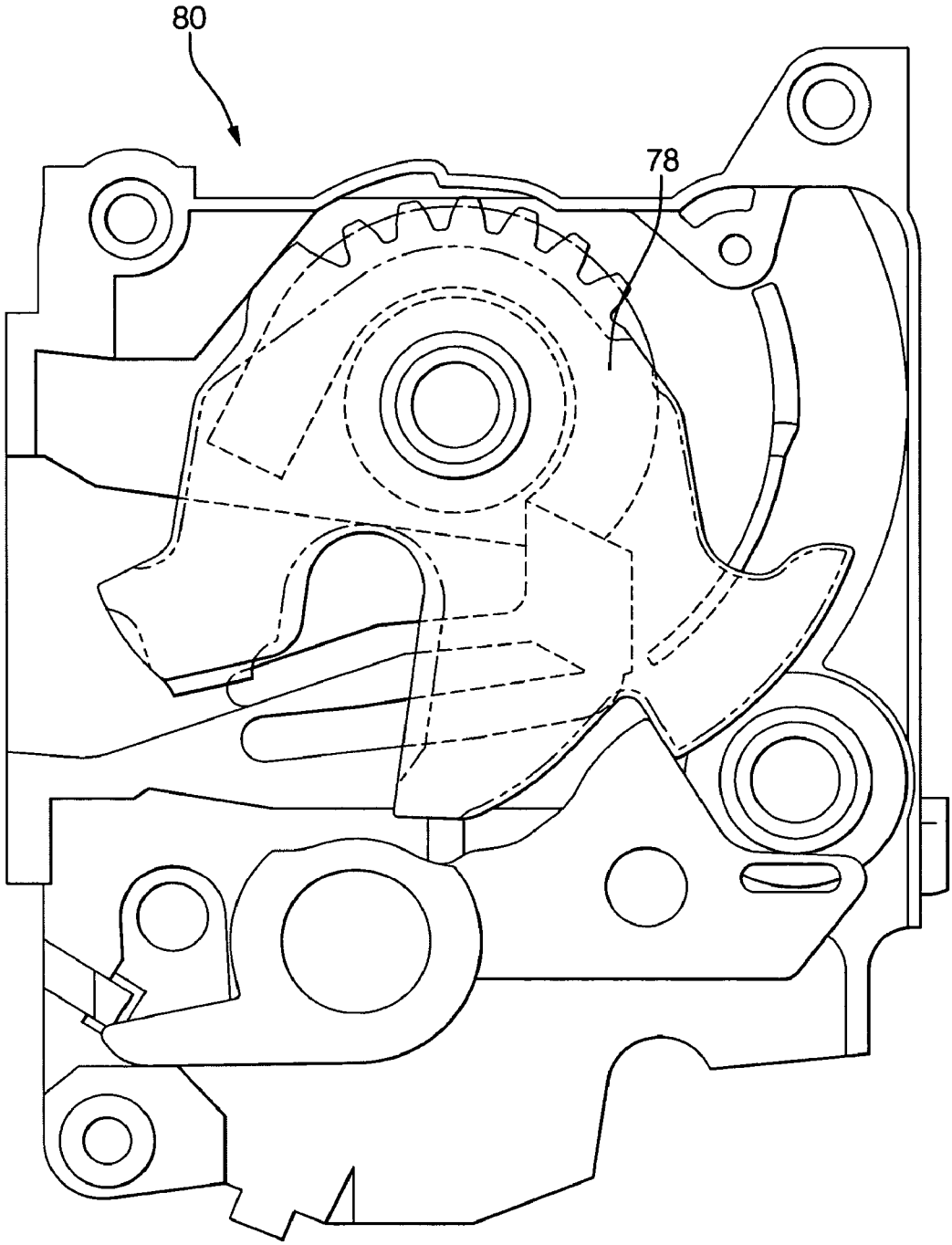
FIGS. 8A and 8B illustrate movement of a fork bolt from a closed secondary position to a primary or locked position.

In an exemplary embodiment, the position of hinge portion 36 in FIG. 4 corresponds to a first position of a fork bolt 78 or other equivalent member of a latch mechanism 80 (FIGS. 1, 8A and 8B) just prior to moving into a second position for engaging a striker 81 or other equivalent member disposed within the frame of the slide door opening. It is noted that the fork bolt and the latching mechanism illustrated in FIGS. 8A and 8B is provided as a non-limiting example and numerous other types of latching mechanisms are contemplated to be used in accordance with exemplary embodiment of the present invention.

Figure 8B:
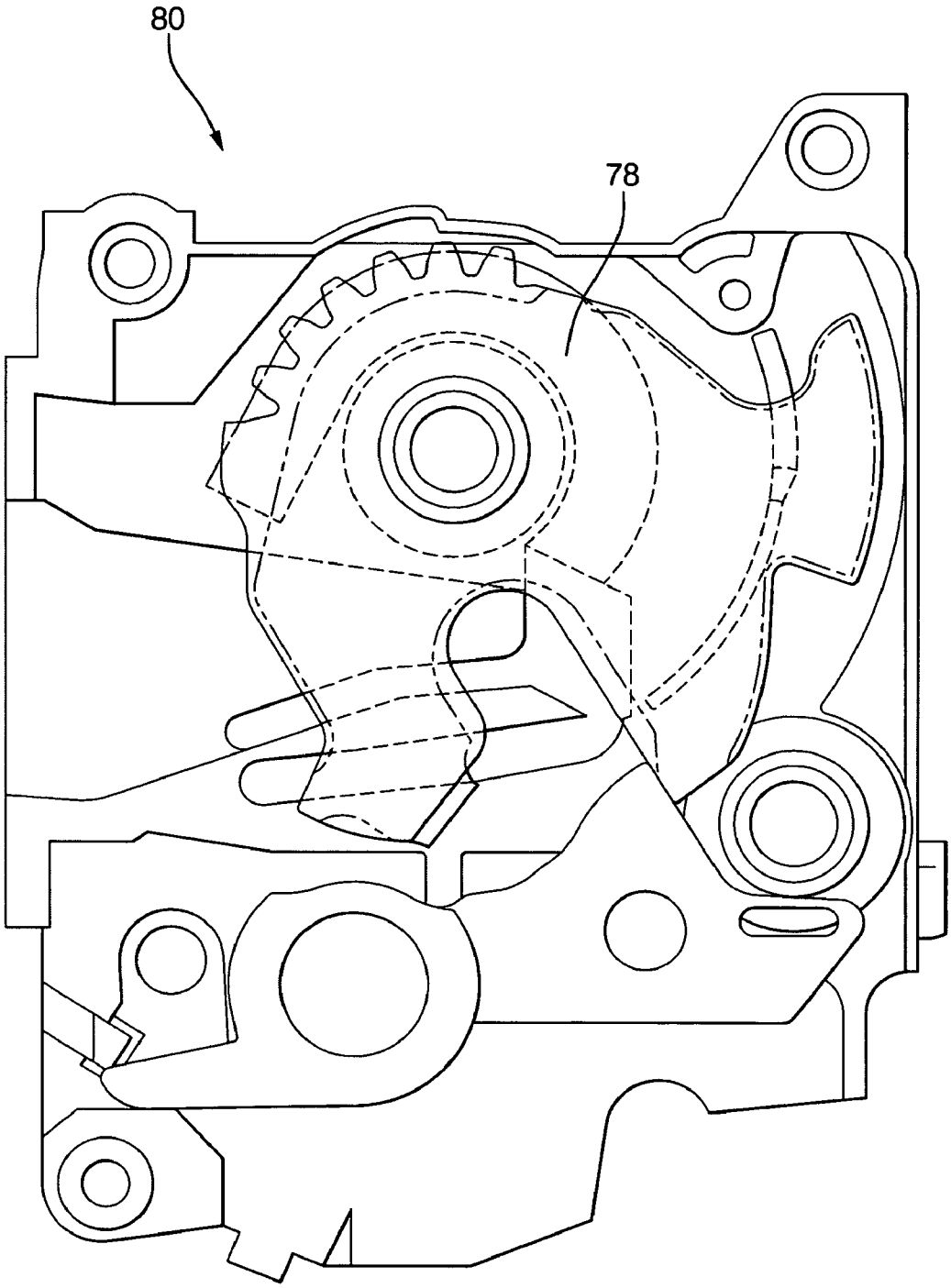

In order to open and close a door, a fork bolt of the door locking mechanism travels from an open position (not shown) to an intermediary secondary position (FIG. 8A) and a primary latched position (FIG. 8B). The open position of fork bolt 78 would correspond to clockwise rotation of fork bolt 78 from the position illustrated in FIG. 8A. This range of movement from open position to latched position and vice versa with the secondary position being therebetween causes the fork bolt to engage and latch the latching mechanism to a striker associated with the door opening. More detailed explanations of vehicle door latch operations and various alternative configurations are found in U.S. Pat. Nos. 5,520,426; 5,277,461; 5,316,354; 5,454,608; 4,969,673; and 5,715,713 the contents of which are incorporated herein by reference thereto.

Accordingly, an in accordance with an exemplary embodiment, the configuration of first hinge portion 32, second hinge portion 36 and guide member 74 are such that the direct pulling of cable 39 upon door 14 occurs when the door is in a position when the latching mechanism is also in a secondary position (e.g., between an open position and a primary (locked position) when the striker is partially engaged by an opening of the fork bolt. This direct pulling in this position allows a more efficient transference of the door sealed force as opposed to pulling on another portion of first hinge portion 32. Thus, the overall motor size may be reduced. Moreover, the corresponding range of movement of the door when the latching mechanism is in the secondary position will typically correspond to the door being aligned with the vehicle door opening, thus only inward movement into the door opening is required and by providing a direct pulling force on the rear portion of the door efficient transference of the door sealing force is provided.

It is also understood, that the positions of first hinge portion 32 and second hinge portion 36 (illustrated in FIG. 4) may, in an alternative embodiment, correspond to the latching member being in a primary position thus, the direct pulling occurs only when the latching mechanism is in the primary (latched) position.

It is also understood, and in yet another alternative embodiment the positions of first hinge portion 32 and second hinge portion 36 (illustrated in FIG. 4), correspond to the latching member being in an open position just before entering or rotating into the secondary position or alternatively the orientation of first hinge portion 32 and second hinge portion 36 correspond to latching mechanism being in the secondary position just before entering the primary (latched) position. In other words and in accordance with exemplary embodiments of the present invention, the direct pulling of the cable on the rear portion of the door (FIG. 4) can occur in any stage of movement of the latching mechanism in order to provide efficient transference of a closing force to the door.

It is also noted that pulley 48 in FIGS. 2 and 4 is illustrated as being positioned for rotation about a vertical axis as opposed to pulley 48 in FIG. 2 being positioned for rotation about a horizontal axis. Furthermore, it is understood that the terms horizontal axis and vertical axis referred to one of many angular configurations of an axis of rotation of pulley 48. More particularly, and in accordance with an exemplary embodiment, pulley 48 is positioned such that when second hinge portion 36 is orientated with respect to first hinge portion 32 (as illustrated in FIG. 4), the positioning and size of pulley 48 is located so that cable 39 is allowed to pull directly on a rear portion of door 14.

In addition, and when second hinge portion 36 has rotated or pivoted to the position illustrated in FIG. 4, there is no bending of the cable from pulley 48 to cable attachment 35 thus lower forces are required to seal the door (e.g., door seal force) as opposed to other applications wherein the front cable (cable 39) is attached to first hinge portion 32.

Initial testing has shown a reduction in the force required to seal the door between 30-40 percent of the original force required to seal the door. By reducing this force many benefits are realized. First, the cable diameter can be reduced because the seal force has been reduced. Second, and when the cable diameter has been reduced the minimum bending diameter the cable is reduced. This allows the pulleys and cable drums to have smaller dimensions. Also, the lower closing force allows the components of the motor drive unit to be reduced in size as lower outputs are required.

This also allows a smaller pulley 48 to be mounted or located on the "C" pillar or behind the "B" pillar depending on usage of either the lower guide track or the center guide track of the vehicle thus, reducing the impact of the pulley on the real estate of the vehicle. In addition, by reducing the amount of force necessary to seal or cinch the door the motor and clutch size is capable of being reduced thereby reducing the cost and weight added by these components.

Figure 6:
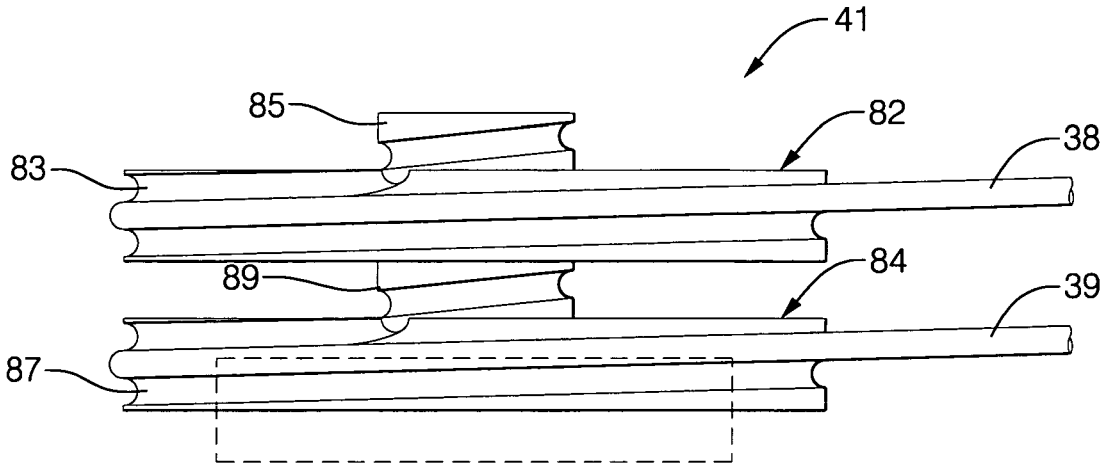
FIG. 6 is a side elevational view of a cable drum of an alternative embodiment of the present invention.

By connecting cable 39 directly to the vehicle door or cable connector 35 the overall length of cable 39 is larger than if the cable was connected to the first hinge portion 32. Accordingly, drum 41 in one exemplary embodiment is configured to have the profile or configuration illustrated in FIG. 6; here cable drum 41 has an upper drum portion 82 having a larger diameter portion 83 and a smaller diameter portion 85 and a lower drum portion 84 having a larger diameter portion 87 and a smaller diameter portion 89. Accordingly, cable 39 is secured to the larger diameter portion of the lower drum portion 84 wherein cable 39 wraps onto the smaller diameter portion during closing of the door when the smaller diameter portion causes an increased force to be applied to the cable.

Figure 7:
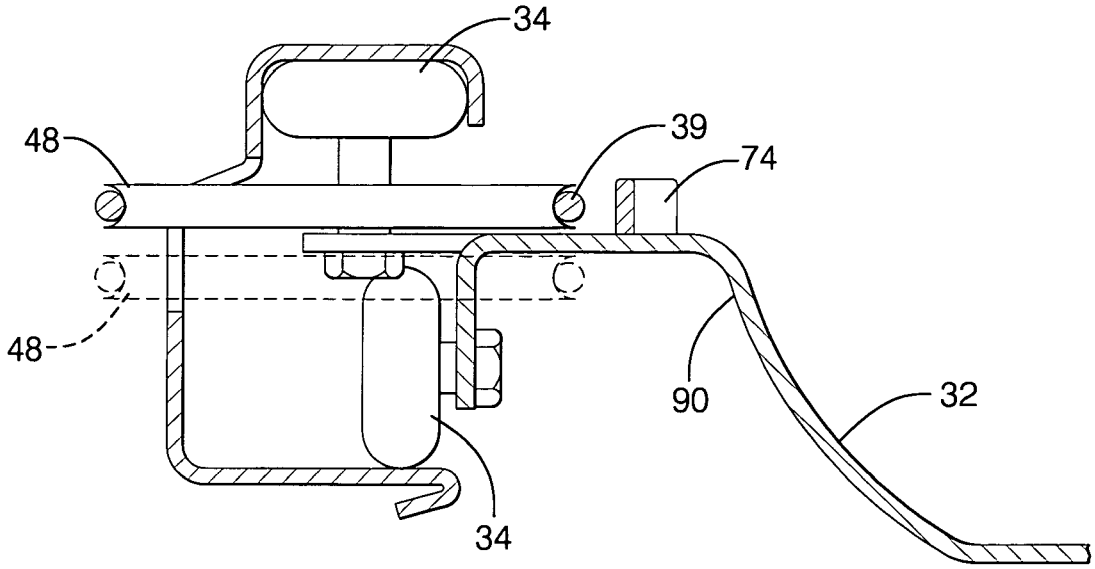
FIG. 7 is a partial cross-sectional view of a portion of the hinge assembly constructed in accordance with an exemplary embodiment of the present invention.

Referring now to FIG. 7, a partial cross-sectional side elevational view of first hinge portion 32 is illustrated. In accordance with an alternative exemplary embodiment pulley 48 is relocated to the position illustrated by the dashed lines illustrated in FIG. 7 and a lower surface portion 90 of first hinge portion 32 provides the feature of guide member 74. Accordingly, first hinge portion 32 is configured to provide a curved surface for interacting with the portion of cable 39 pass second hinge portion 36 pivots with respect to first hinge portion 32 (FIGS. 4 and 5).

In yet another alternative embodiment, surface 90 of first hinge portion 32 will comprise a material having a low coefficient of friction or smooth surface such as a polymeric material.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the present application.

What is claimed is:

1. A hinge assembly for coupling a sliding door to a vehicle for sliding the sliding door from an open position to a closed position, the hinge assembly sliding within a guide track as the door moves between the open position and the closed position, the hinge assembly comprising:

a first hinge portion;

a second hinge portion, said first hinge portion being pivotally secured to said second hinge portion;

a cable attachment being mounted on said second hinge portion; and a guide surface disposed on a surface of said first hinge portion, said guide surface contacting a portion of a cable for sliding the sliding door between the open and closed positions when said second hinge portion is in a first orientation with respect to said first hinge portion and said cable no longer contacting said guide surface as said second hinge portion moves from said first orientation to a second orientation with respect to said first hinge portion;

wherein said cable has an end mounted to said cable attachment; and wherein said cable attachment moves closer to said first hinge portion as said second hinge portion moves from said first orientation to said second orientation.

2. The hinge assembly as in claim 1, wherein said first hinge portion is pivotally secured to said second hinge portion by a pivot pin.

3. The hinge assembly as in claim 1, wherein said first hinge portion further comprises a plurality of rollers for being slidably received within the guide track.

4. The hinge assembly as in claim 1, wherein said first orientation of said second hinge portion corresponds to the open door position and said second orientation of said second hinge portion corresponds to the closed door position.

5. The hinge assembly as in claim 4, wherein movement of said second hinge portion from said first orientation to said second orientation is caused when said first hinge portion travels in a curved portion of the guide track.

* * * * *